US011771248B2

(12) United States Patent
Nishida

(10) Patent No.: US 11,771,248 B2
(45) Date of Patent: Oct. 3, 2023

(54) DRINKING DRAMATIZATION GLASS, STORAGE MEDIUM AND REMOTE TOAST COUNTER SYSTEM

(71) Applicant: NETAPPLI CO., LTD., Ishikawa (JP)

(72) Inventor: Makoto Nishida, Ishikawa (JP)

(73) Assignee: NETAPPLI CO., LTD., Ishikawa (JP)

( * ) Notice: Subject to any disclaimer, the term of this patent is extended or adjusted under 35 U.S.C. 154(b) by 0 days.

(21) Appl. No.: 17/636,345

(22) PCT Filed: Dec. 8, 2020

(86) PCT No.: PCT/JP2020/045696

§ 371 (c)(1),
(2) Date: Feb. 17, 2022

(87) PCT Pub. No.: WO2021/192434

PCT Pub. Date: Sep. 30, 2021

(65) Prior Publication Data

US 2022/0312993 A1 Oct. 6, 2022

(30) Foreign Application Priority Data

Mar. 23, 2020 (JP) ..... 2020-070070

(51) Int. Cl.
*A47G 19/22* (2006.01)
*G09F 23/08* (2006.01)

(52) U.S. Cl.
CPC ..... *A47G 19/2227* (2013.01); *A47G 19/2272* (2013.01); *G09F 23/08* (2013.01)

(58) Field of Classification Search
CPC ..... A47G 19/2227; A47G 19/2272; A47G 2019/2238; B65D 2203/12; G09F 23/08; G09F 19/12; G09F 2023/0025
(Continued)

(56) References Cited

U.S. PATENT DOCUMENTS 8,505,766 B2 * 8/2013 Aitchison ..... G02B 25/008 359/823
8,550,288 B2 * 10/2013 Briar ..... A47G 19/2227 220/62.12
(Continued)

FOREIGN PATENT DOCUMENTS

JP 6337256 B1 6/2018
JP 6406742 B1 10/2018
(Continued)

OTHER PUBLICATIONS

International Search Report (ISR) dated Feb. 22, 2021, issued for International application No. PCT/JP2020/045696. (2 pages).

*Primary Examiner* — Cassandra Davis
*Assistant Examiner* — Madison L Poos
(74) *Attorney, Agent, or Firm* — Law Office of Katsuhiro Arai

(57) ABSTRACT

A drinking dramatization glass includes: a glass body being a bottomed cylinder body having a curved part that curves in the horizontal direction as well as a top opening; a fixing mechanism for fixing a video display device on the glass body; and an image aspect ratio control part for changing the aspect ratio of an image on the video display device. The drinking dramatization glass is configured to compensate for a horizontal distortion of images viewed through the drink in the glass.

5 Claims, 5 Drawing Sheets

(58) Field of Classification Search
USPC ..... 215/387, 390; 220/662, 663, 669, 703
See application file for complete search history.

(56) References Cited

U.S. PATENT DOCUMENTS

| | | | | |
|---|---|---|---|---|
| 10,966,554 | B1 * | 4/2021 | Nishida | A47G 23/16 |
| 2021/0000274 | A1 | 1/2021 | Nishida | |
| 2021/0085105 | A1 * | 3/2021 | Nishida | H04M 1/04 |
| 2021/0244213 | A1 * | 8/2021 | Nishida | A47G 19/2227 |
| 2021/0330104 | A1 * | 10/2021 | Nishida | A47G 19/2227 |

FOREIGN PATENT DOCUMENTS

| | | | |
|---|---|---|---|
| JP | 6432960 | B1 | 12/2018 |
| JP | 6488049 | B1 | 3/2019 |
| JP | 6528162 | B1 | 6/2019 |
| JP | 2019141361 | A | 8/2019 |

* cited by examiner

[FIG. 1]
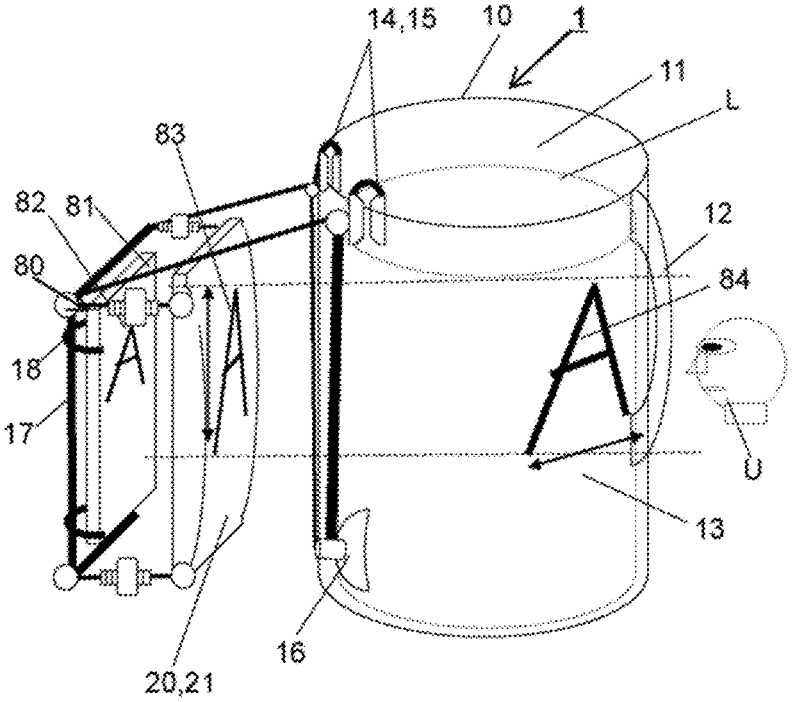
[FIG. 2]
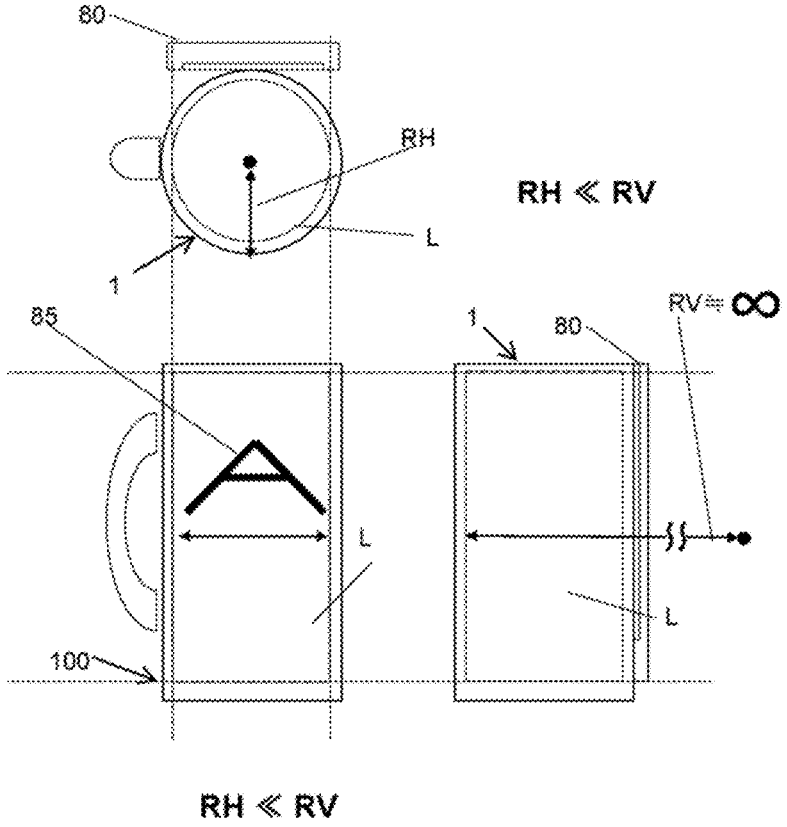

[FIG. 3]
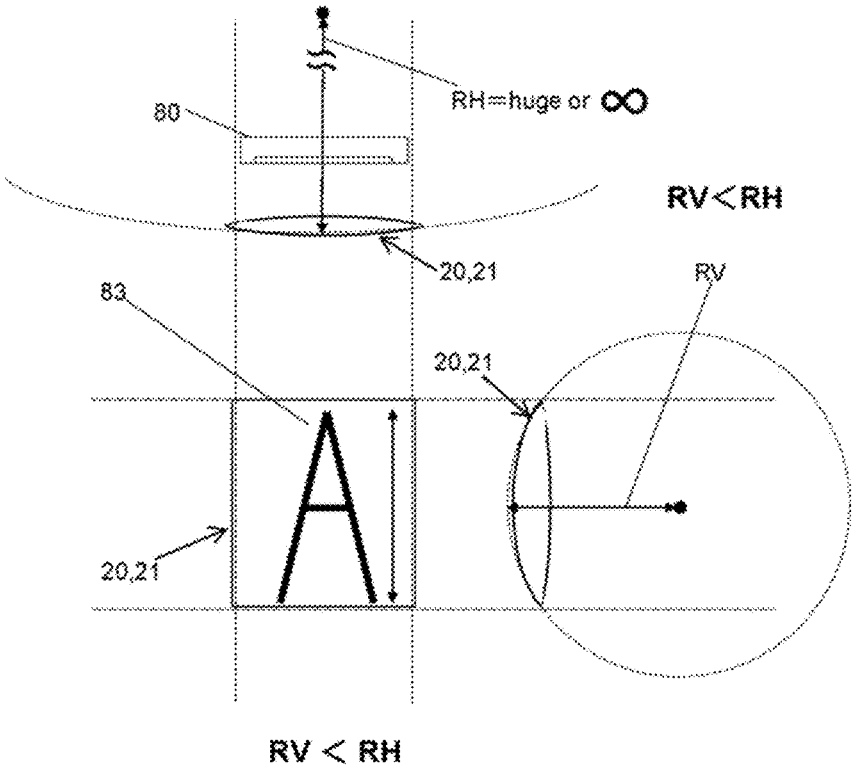
[FIG. 4]
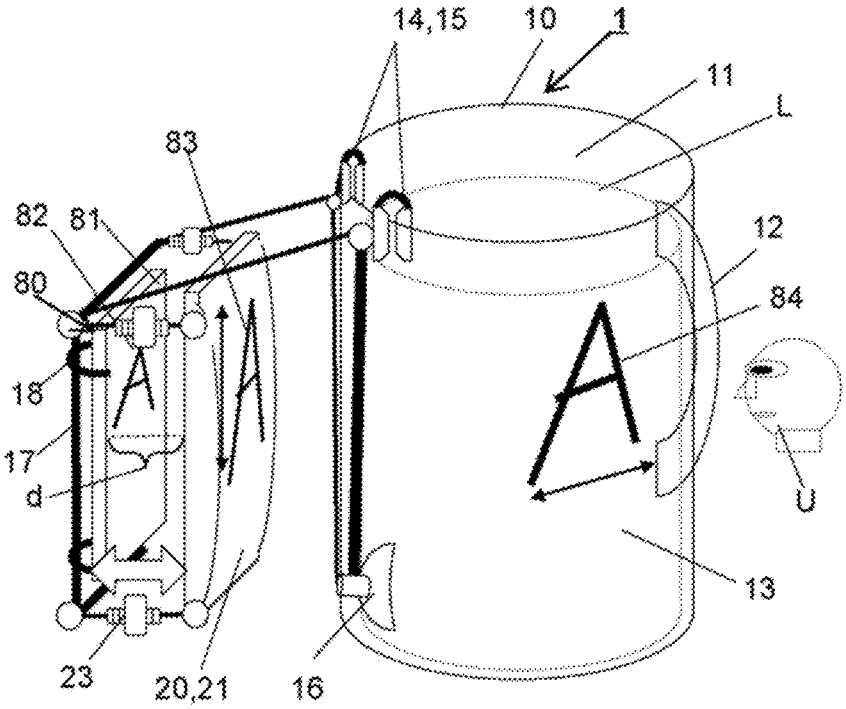

[FIG. 5]
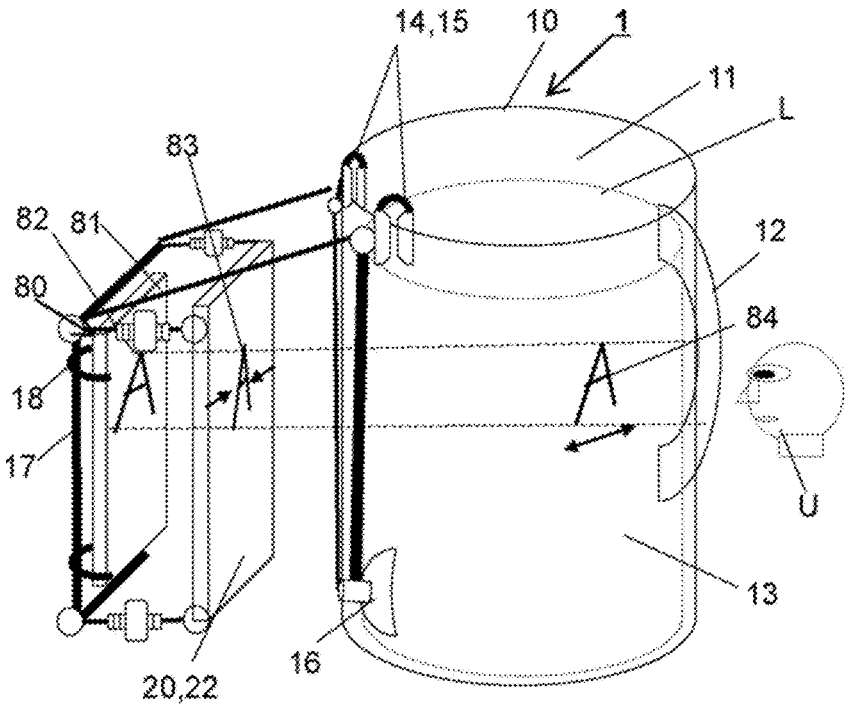
[FIG. 6]
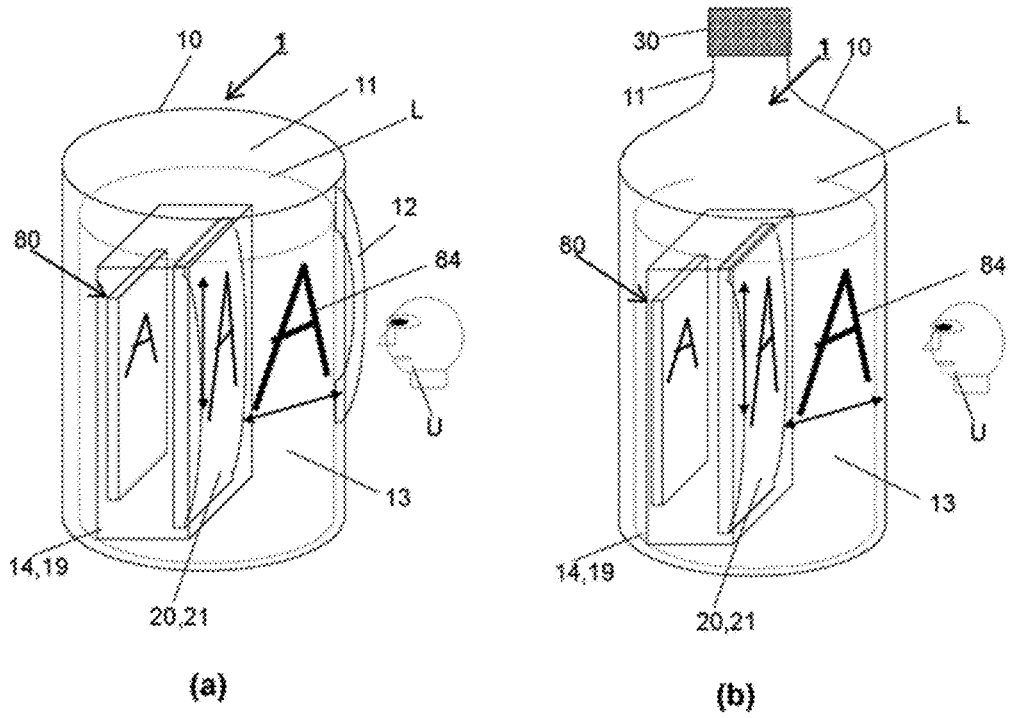

[FIG. 7]
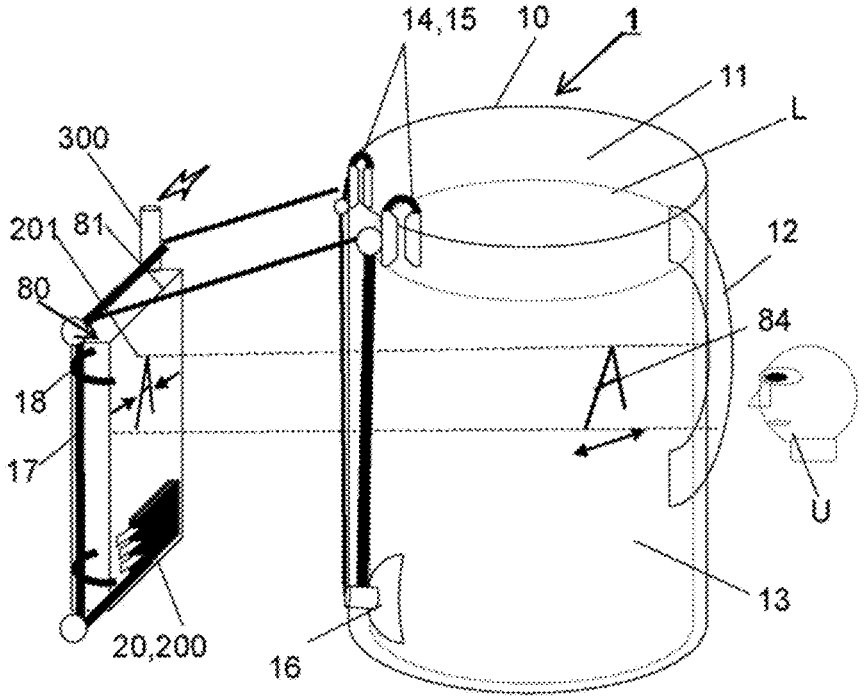
[FIG. 8]
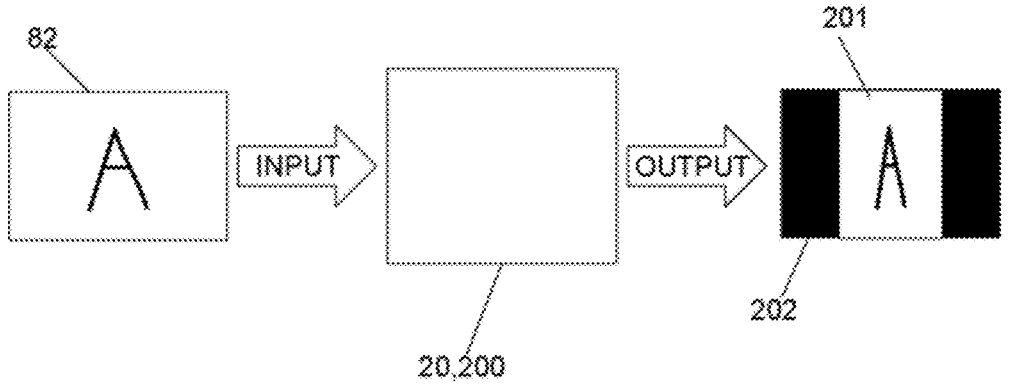

[FIG. 9]
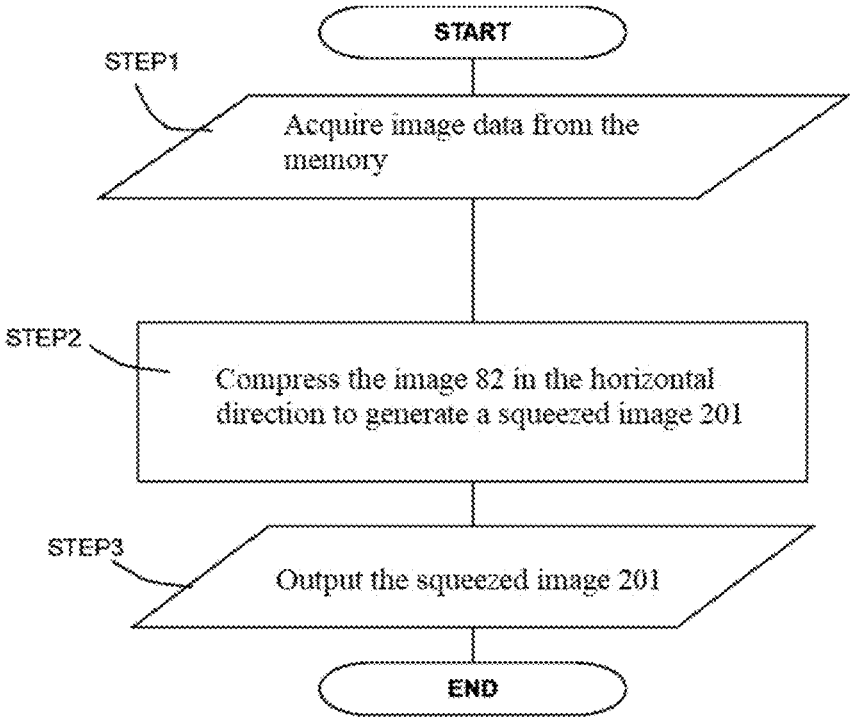
[FIG. 10]
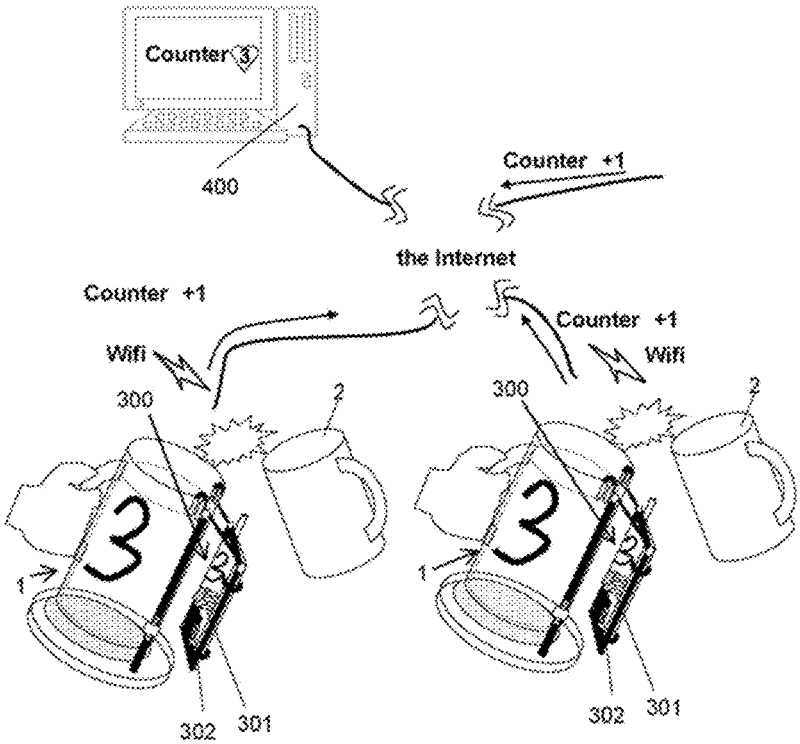

DRINKING DRAMATIZATION GLASS, STORAGE MEDIUM AND REMOTE TOAST COUNTER SYSTEM

CROSS-REFERENCE TO RELATED APPLICATIONS

This application is the U.S. National Phase under 35 U.S.C. § 371 of International Application PCT/JP2020/045696, filed Dec. 8, 2020, which claims priority to Japanese Patent Application No. JP2020-070070, filed Mar. 23, 2020. The International Application was published under PCT Article 21(2) in a language other than English.

TECHNICAL FIELD

The present invention relates to a drinking dramatization glass for displaying images free of the distortion that would otherwise be caused by the lens effect of water or other drink inside its drinking container.

BACKGROUND ART

Glasses have been developed that offer various functions in addition to containing drinks.

For example, Patent Literatures 1 to 3 disclose drinking dramatization glasses invented by the inventor of the invention under the present application for patent. These drinking dramatization glasses each comprise: a glass body; a storage part extending from the bottom part, toward the interior side, of the glass body for storing a mobile communication device; and a waveguide part extending from the side face, toward the interior side, of the glass body for letting the radio waves from the mobile communication device pass through. These drinking dramatization glasses can communicate wirelessly by outputting the radio waves from the mobile communication device to the exterior via the waveguide part, even when a drink is filled in the glass body.

Patent Literature 4 discloses a drinking dramatization glass invented by the inventor of the invention under the present application for patent. This drinking dramatization glass comprises a video display device fixed on the side face of the glass, as well as a reflective mirror placed inside the glass body, so that the glass can achieve a dramatization effect of projecting a pseudo-image inside the glass based on the image on the video display device.

BACKGROUND ART LITERATURE

Patent Literature

Patent Literature 1: Japanese Patent No. 6337256
Patent Literature 2: Japanese Patent No. 6406742
Patent Literature 3: Japanese Patent No. 6432960
Patent Literature 4: Japanese Patent No. 6488049

SUMMARY OF THE INVENTION

Problems to be Solved by the Invention

However, regular cups and beer mugs, including the aforementioned drinking dramatization glasses according to Patent Literatures 1 to 4, have a cylindrical or near-cylindrical shape whose side face is always curved in the horizontal direction, which means that when the user views an image projected from the interior or side face of the drinking container through the drink inside the drinking container, the image is inevitably distorted into one magnified in the horizontal direction.

In light of the aforementioned problems, one object of the present invention is to provide a drinking dramatization glass with a built-in mechanism for compensating for the horizontal distortion of images viewed through the drink in the glass, so that the images will not become magnified only in the horizontal direction or lateral direction and consequently distorted.

Another object of the present invention is to provide a remote toast counter system using such drinking dramatization glass, and a storage medium in which a program used with such drinking dramatization glass is recorded.

Means for Solving the Problems

The drinking dramatization glass proposed by the present invention comprises: a glass body being a bottomed cylinder body having a curved part that curves in the horizontal direction, as well as a top opening; a fixing mechanism for fixing a video display device on the glass body; and an image aspect ratio control part for changing the aspect ratio of an image on the video display device; wherein such drinking dramatization glass is characterized in that the image aspect ratio control part compensates for the horizontal magnification of the image caused by the drink inside the glass body.

Additionally, it is characterized in that it has a lens as the image aspect ratio control part and the radius of curvature of the lens in the horizontal direction is greater than its radius of curvature in the vertical direction.

Additionally, it is characterized in that it has a lens-distance adjustment mechanism for adjusting the distance between the lens and the video display device.

Additionally, it is characterized in that the lens has an infinitely large radius of curvature in the horizontal direction.

Additionally, it is characterized in that the lens is a minus lens that reduces an image on the video display device in the horizontal direction.

Additionally, it is characterized in that it has, as the image aspect ratio control part, a squeezed-image generator for generating a squeezed image which is an image that has been compressed in the horizontal direction.

Additionally, it is characterized in that the video display device constitutes a part of a mobile communication device and the squeezed-image generator represents computer software built into the mobile communication device.

Additionally, it is characterized in that it has, as the fixing mechanism, and inside the glass body, a storage part in which the video display device is stored.

Additionally, it is characterized in that it has a lid for closing off the top opening.

The remote toast counter system proposed by the present invention comprises: the aforementioned drinking dramatization glass; the aforementioned mobile communication device; an external server computer; and a user operation detection part; wherein such remote toast counter system is characterized in that the user operation detection part detects, based on data output from an acceleration sensor or camera sensor in the mobile communication device, that the user has moved or tilted the glass body or clinked it against other object (hereinafter referred to as "user operation") and then transmits an output signal to the external server computer, while the external server computer receives the output signal, counts the number of times such signal has been received, and records the result as a cumulative number of toasting operations, so that the user can view the cumulative number of toasting operations.

The storage medium proposed by the present invention is a storage medium in which a computer program used with the aforementioned drinking dramatization glass is saved, wherein such storage medium is characterized in that the computer program generates a squeezed image which is an image output to the aforementioned video display device that has been compressed in the horizontal direction.

Effects of the Invention

The drinking dramatization glass proposed by the present invention can function with every glass, cup, beer mug, or other drinking container having a cylindrical or near-cylindrical shape, by canceling the lens effect in the horizontal direction of any cylindrically shaped drink (liquid) inside the drinking container. Accordingly, use of the drinking dramatization glass proposed by the present invention allows for viewing, through the drink inside the drinking container, an image on the video display device fixed on the side face of or inside the drinking container, in the original aspect ratio of the image. This effect is particularly notable with images that contain text.

Because of the fixing mechanism for fixing the video display device, the video display device on the side face of the glass will not drop off when the glass is moved or clinked for a toast, or the glass is tilted.

The drinking dramatization glass proposed by the present invention has, as the image aspect ratio control part, the squeezed-image generator for generating a squeezed image which is an image that has been compressed in the horizontal direction, where any image that has been compressed in the horizontal direction produces blank spaces. This allows other squeezed image or images to be inserted in the blank space(s) so that two or more images can be projected in the horizontal direction through the drinking container. It should be noted that, if the squeezed-image generator is implemented as computer software built into the mobile communication device, an image on this mobile communication device can be viewed through the drink inside the drinking container in its original aspect ratio.

Use of the drinking dramatization glass proposed by the present invention allows for building of a remote toast counter system that counts and displays a number of toasts made at remote locations by drinking containers of various shapes.

BRIEF DESCRIPTION OF THE DRAWINGS

FIG. 1 A perspective view showing the drinking dramatization glass in the first embodiment.

FIG. 2 A drawing showing the principle of why an image passing only through the drinking container is magnified only in the horizontal direction.

FIG. 3 A drawing showing the lens used as the image aspect ratio control part.

FIG. 4 A perspective view showing a drinking dramatization glass that makes variable the distance between the video display device and the lens.

FIG. 5 A perspective view showing an example of a drinking dramatization glass whose lens is a minus lens.

FIG. 6 Perspective views (a) and (b) showing examples of drinking dramatization glasses of different shapes.

FIG. 7 A perspective view showing the drinking dramatization glass in the second embodiment.

FIG. 8 A process flow diagram of the squeezed-image generator.

FIG. 9 A flowchart of a horizontal/vertical image compression program.

FIG. 10 A drawing showing the constitution of a remote toast counter system.

MODE FOR CARRYING OUT THE INVENTION

[First Embodiment of Drinking Dramatization Glass]

The first embodiment of the drinking dramatization glass proposed by the present invention is presented below using the drawings.

As shown in FIG. 1, the drinking dramatization glass 1 roughly comprises: a glass body 10 being a bottomed cylinder having a curved part 13 that curves in the horizontal direction, as well as a top opening 11; a fixing mechanism 14 for fixing a video display device 80 on the glass body 10; and an image aspect ratio control part 20 for changing the aspect ratio of an image 82 on the video display device 80.

The fixing mechanism 14 is a fixing mechanism for fixing the video display device 80 on the glass body 10, where, in FIG. 1, one that combines a clamp mechanism 15 for clamping the end part of the top opening 11 and a fixing frame 17 on which U-shaped metal fittings 18 are provided is used. The fixing mechanism 14 used may be a fixing mechanism of any type so long as it can fix the video display device 80 on the glass body 10, and the fixing mechanism 14 may also be one that combines a screw mechanism, suction cup, etc. The material of the fixing mechanism 14 is not limited in any way, but a transparent material is desired in that it will not block the video display surface 81 of the video display device 80.

The image aspect ratio control part 20 is provided to prevent the image 82 on the video display device 80 from becoming magnified only in the horizontal direction and consequently distorted as it passes through the cylindrically shaped drink L inside the drinking dramatization glass 1. It should be noted that one possible method for the image aspect ratio control part 20 is to use a sheet-shaped (or film-shaped) lens comprising a sheet (or film) embossed with a Fresnel lens pattern. In the example of FIG. 1, an optical lens 21 is used as the image aspect ratio control part 20. The lens 21 has been processed to magnify the image only in the vertical direction (or longitudinal direction), so the image 82 is magnified only in the vertical direction, just like the image 83 in FIG. 1, as it passes through the lens 21. As it passes through the drink L via the lens 21, the image 82 is prevented from becoming magnified only in the horizontal direction (or lateral direction) and consequently distorted (that is, the image 83 that has been magnified in the vertical direction is generated using the lens 21 in order to make the aspect ratio of the image 82 identical to that of the image 84 that has passed through the drinking dramatization glass 1). The material of the lens 21 is possibly transparent glass, acrylic, etc. In the example of FIG. 1, the lens 21 is placed at a position between the video display device 80 and the drinking dramatization glass 1; however, the placement position of the lens 21 is not limited in any way so long as the image 82 on the video display device 80 can be projected on it at its position. It should be noted that, regarding the method for implementing the image aspect ratio control part 20, a digital technique that applies image squeeze compression software is also a possibility, in addition to an analog technique that uses an optical lens like the lens 21 in FIG. 1. Details will be explained in the other embodiment mentioned below.

It should be noted that the drinking dramatization glass 1 proposed by the present invention is assumed to be a bottomed cylinder body, just like any regular beer mug. The drinking dramatization glass 1 may also be shaped like a cup without the handle 12 in FIG. 1.

It should be noted that, in the example of FIG. 1, the drinking dramatization glass 1 (or glass body 10) is assumed to be entirely made of transparent glass or transparent resin, just like any regular glass; under the present invention, however, the glass body 10 need not be entirely transparent, and so long as the glass body 10 has on its side face at least one transparent area that lets images pass through, the remaining parts may not be transparent.

To explain the details of the lens 21, the lens effect in the horizontal direction caused by the liquid or drink in the drinking container is explained first.

Just like in any regular beer mug or cup, the drink L inside the drinking dramatization glass 1 (or glass body 10) being a bottomed cylinder body having the curved part 13 that curves in the horizontal direction, inevitably has a cylindrical or near-cylindrical shape as shown in FIG. 1 and FIG. 2. Since the cylindrical shape does not curve in the vertical direction, the drink L is deemed to have an infinitely large radius of curvature in vertical direction RV, as shown in FIG. 2. On the other hand, the drink L is circularly curved in the horizontal direction, which means that its radius of curvature in horizontal direction RH is always a finite value (in the case of a regular size glass, the radius of curvature RH of the drink L is anywhere from several centimeters to 10 centimeters or so). In other words, the drink L has a radius of curvature in vertical direction RV that is significantly greater than its radius of curvature in horizontal direction RH. It is known that the magnification factor of an optical lens becomes greater as the radius of curvature of the lens becomes smaller (for details, refer to technical books on lens formulas and optical science), and also because the optical refraction index of water is greater than that of air, the image 85 that passes only through the drink L inside the drinking dramatization glass 1 is magnified only in the horizontal direction and consequently distorted significantly, as shown in FIG. 2 (to put it differently, the image is distorted as the drink L acts as a lens that magnifies it only in the horizontal direction).

The lens 21 used as the image aspect ratio control part 20 is a lens whose image magnification factor in the vertical direction is greater than its image magnification factor in the horizontal direction, or specifically a double-convex lens (or plano-convex lens) whose radius of curvature in horizontal direction RH is greater than its radius of curvature in vertical direction RV, as shown in FIG. 3. As a result, the lens effect in the horizontal direction caused by the drink L can be cancelled out by placing the lens 21 between the video display device 80 and the drinking dramatization glass 1. This means that, by using the lens 21 having an appropriate image magnification factor in the vertical direction, the user U can view through the drink the distortion-free image 84 that has been magnified equally in the horizontal direction and vertical direction, as shown in FIG. 1.

There is one very important point regarding the lens 21 that requires caution, which is that a standard lens whose radius of curvature in horizontal direction RH is equal to its radius of curvature in vertical direction RV must not be used as the lens 21. This is because a standard lens having equal magnification factors in the horizontal direction and vertical direction cannot change the aspect ratio of the image 82 and thus theoretically is unable to cancel any horizontal distortion therein caused by the drink L. Accordingly, for the lens 21, a lens whose radius of curvature in horizontal direction RH is greater than its radius of curvature in vertical direction RV (that is, a special lens whose image magnification factor in the vertical direction is greater than its image magnification factor in the horizontal direction) must be used. In an extreme example, a lens that magnifies only in the vertical direction, or specifically a lens whose radius of curvature in horizontal direction RH is infinitely large, may also be used as the lens 21.

It should be noted that the form of the lens 21 does not matter so long as the magnification factor of the lens is greater in the vertical direction than in the horizontal direction. A sheet-shaped Fresnel lens comprising a sheet pressed with a pattern of a lens (whose magnification factor is greater in the vertical direction than in the horizontal direction) may be used as the lens 21. A sheet embossed with a Fresnel lens pattern may be attached to the side face of the glass body 10. A Fresnel lens pattern may be embossed directly on the side face of the glass body 10.

As can be understood from the principle of magnifying glass, generally the greater the distance between the optical lens and the object, the greater the factor by which the object is magnified (for details, refer to technical books on lens formulas and optical science). Accordingly, the factor by which the image 84 is magnified in the vertical direction can be controlled by providing on the drinking dramatization glass 1 a lens distance adjustment mechanism 23 for adjusting the distance d between the video display device 80 and the lens 21, as shown in FIG. 4. By using the lens distance adjustment mechanism 23, the user U can find an optimal distance d (or magnification factor in the vertical direction) that cancels out the distortion caused by the lens effect of the drink L. Additionally, by using the lens distance adjustment mechanism 23, the user U can adjust the magnification factor of the lens 21 according to the diameter of the drinking dramatization glass 1 and type of the drink L.

It should be noted that, as shown in FIG. 5, a minus lens 22 that reduces or compresses images in the horizontal direction may be placed between the video display device 80 and the drink L instead of the lens 21. The minus lens 22, which is a plano-concave lens (or double-concave lens) with concave-shaped horizontal cross-section whose image magnification factor in the horizontal direction is smaller than 1, is used to compensate for the horizontal magnification of images caused by the drink L.

It should be noted that, in addition to using only one lens 21 or minus lens 22, multiple lenses may be placed next to each other, in which case focus adjustment becomes of greater concern and thus one separate lens for adjusting the focus may be inserted.

FIG. 6 presents perspective views showing examples of drinking dramatization glasses of different shapes.

As shown in FIG. 6 (*a*), a storage part 19 may be provided inside the glass body 10 as the fixing mechanism 14 for fixing the video display device 80. The advantage of this method is that, since the video display device 80 is not on the exterior side, no damage occurs to the video display device 80 during toasting operations as the drinking dramatization glass 1 comes in contact with other glasses.

It should be noted that, as for its shape, the drinking dramatization glass 1 may not only have a regular beer mug shape, but it may also have a bottle shape having a lid 30 for closing off the top opening 11, as shown in FIG. 6 (*b*).

[Second Embodiment of Drinking Dramatization Glass]

The second embodiment of the drinking dramatization glass proposed by the present invention is presented below using the drawings, where locations that are constitutionally identical to the corresponding locations in the drinking dramatization glass 1 in the aforementioned first embodiment are denoted using the same symbols, and not explained.

In this embodiment, a squeezed-image generator 200 is used, instead of the lens 21, as the image aspect ratio control part 20, as shown in FIG. 7. The squeezed-image generator 200 generates, from the data of the image 82 on the video display device 80, and by computer image processing, a squeezed image 201 that has been compressed or reduced in the horizontal direction, as shown in FIG. 8 (in other words, the squeezed-image generator in FIG. 7 acts in the exact same manner as the minus lens 22 in FIG. 5 explained in the aforementioned first embodiment).

Since the squeezed image 201 is an image that corresponds to the original image 82 but is already reduced in the horizontal direction, the horizontal magnification of the image caused by the drink L can be compensated for, as shown in FIG. 7.

The squeezed-image generator 200 may be implemented in a dedicated IC chip installed in the drinking dramatization glass 1, or it may be implemented as software on an external server computer. Additionally, if the video display device 80 is a part of a mobile communication device 300, as shown in FIG. 7, then the squeezed-image generator 200 may be implemented as computer software built into the mobile communication device 300.

It should be noted that, for the algorithm for generating the squeezed image 201 compressed in the horizontal direction, any known algorithm built into an LD player, DVD player or photo retouching software may be used.

FIG. 9 shows a flowchart of a computer program for generating or outputting the squeezed image 201 by compressing the image 82 in the horizontal direction (lateral direction).

In STEP 1, data of the original image 82 that has not been compressed in the horizontal direction is loaded from the memory of the computer in the video display device 80 or mobile communication device 300. In STEP 2, the image 82 is compressed in the horizontal direction (lateral direction) to create the squeezed image 201. Then, in STEP 3, this squeezed image 201 is output to the video display device 80 or mobile communication device 300.

It should be noted that the computer program represented by the flowchart shown in FIG. 9 may be saved in a flash memory, DRAM, magnetic storage medium, optical storage medium or other known storage medium. It may also be installed (saved) in the memory of the mobile communication device 300 in the form of application software.

It should be noted that generating the squeezed image 201 being the image 82 compressed or reduced in the horizontal direction inevitably creates blank spaces (English: pillarbox) 202 on the left and right of the image, corresponding to how much of it was compressed, as shown in FIG. 8. Other squeezed images may be embedded in these blank spaces 202, and by applying this principle, an image comprising two or three screens-worth of images can be projected through the drinking dramatization glass 1.

It should be noted that the image 82 and squeezed image 201 may be an image in an individual frame constituting a video.

[Embodiment of Remote Toast Counter System]

An embodiment of the remote toast counter system proposed by the present invention is explained below. Locations that are constitutionally identical to the corresponding locations in the drinking dramatization glass in each of the aforementioned embodiments are denoted using the same symbols, and not explained.

A majority of models of mobile phones, smartphones, and other mobile communication devices have a built-in acceleration sensor or camera sensor. An acceleration sensor allows for acquisition of the amount of movement or tilting of the object into which the acceleration sensor is built, and whether or not the object has hit another object, based on the acceleration of the object. A camera sensor, too, can acquire the amount of movement or tilting of the object, and whether or not it has hit another object, by means of image analysis. (In other words, operations performed on the glass body 10 by the user can be detected by analyzing the signals or data from these sensors.) Accordingly, the remote toast counter system in this embodiment comprises a drinking dramatization glass 1 conforming to the present invention, a mobile communication device 300, an external server computer 400, and a user operation detection part 302, as shown in FIG. 10.

Based on the signal from a sensor 301 in the mobile communication device 300, the user operation detection part 302 detects a user operation performed on the glass body 10 (an operation of tilting or clinking it against other drinking glass 500, etc.) and transmits a signal to the server computer 400 at a remote location, etc. As shown in FIG. 10, the server computer 400 at a remote location counts the number of times such signal has been received and records the result as a cumulative number of toasting operations for viewing or publication, and thus a remote toast counter system is obtained.

It should be noted that the user operation detection part 302 may be implemented in a dedicated IC chip installed in the drinking dramatization glass 1, or it may be implemented on the external server computer or in the mobile communication device 300.

INDUSTRIAL FIELD OF APPLICATION

The present invention is a drinking dramatization glass for fixing a video display device thereon, and as it can prevent images from becoming magnified only in the horizontal direction and consequently distorted due to the lens effect of the drink inside the drinking container, the user can view distortion-free images even through the drink. Based on the above, the present invention has industrial applicability.

DESCRIPTION OF THE SYMBOLS

L Drink (liquid)
RV Radius of curvature (in vertical direction)
RH Radius of curvature (in horizontal direction)
U User
d Distance
1 Drinking dramatization glass
2 Drinking dramatization glass
10 Glass body
11 Top opening
12 Handle
13 Curved part
14 Fixing mechanism
15 Clamp mechanism
16 Suction cup
17 Fixing frame
18 Metal fitting
19 Storage part
20 Image aspect ratio control part

21 Lens
22 Minus lens
23 Lens distance adjustment mechanism
30 Lid
80 Video display device
81 Video display surface
82 Image
83 Image (image that has passed through the lens)
84 Image (image that has passed through the lens and drink)
85 Image (image that has passed only through the drink)
100 Drinking container
200 Squeezed-image generator
201 Squeezed image
202 Blank space (pillarbox)
300 Mobile communication device
301 Sensor (acceleration sensor, camera sensor)
302 User operation detection part
400 Server computer

What is claimed is:

1. A drinking dramatization glass comprising:

a glass body being a bottomed cylinder body having a curved part, which curves in a horizontal direction, and a top opening;

a fixing mechanism for fixing a video display device on the glass body; and an image aspect ratio control part for changing an aspect ratio of an image on the video display device;

wherein the image aspect ratio control part compensates for a horizontal magnification of the image caused by a drink inside the glass body, and wherein, as the image aspect ratio control part, provided is a squeezed image generator for generating a squeezed image which is an image that has been compressed in the horizontal direction.

2. The drinking dramatization glass according to claim 1, further comprising the video display device which is constituted by a part of a mobile communication device which is fixed on the glass body by the fixing mechanism, wherein the squeezed image generator represents computer software built into the mobile communication device.

3. A remote toast counter system, comprising:

the drinking dramatization glass according to claim 2;

an external server computer; and a user operation detection part;

wherein:

the user operation detection part detects, based on data output from an acceleration sensor or camera sensor in the mobile communication device, that a user has moved, tilted, or clinked the glass body against other object; and then transmits an output signal to the external server computer; and the external server computer receives the output signal, counts a number of times such signal has been received and records a result as a cumulative number of toasting operations so that the user can view the cumulative number of toasting operations.

4. A computer readable non-transitory medium in which a computer program used with the drinking dramatization glass according to claim 1 is stored, wherein the computer program is executed by a computer processor to generate a squeezed image which is an image output to the video display device that has been compressed in the horizontal direction.

5. The drinking dramatization glass according to claim 1, wherein, as the fixing mechanism, and inside the glass body, provided is a storage part in which the video display device is stored.

* * * * *